US011384460B2

(12) United States Patent
Dilo

(10) Patent No.: US 11,384,460 B2
(45) Date of Patent: Jul. 12, 2022

(54) NEEDLEPUNCHING MACHINE

(71) Applicant: Oskar Dilo Maschinenfabrik KG, Eberbach (DE)

(72) Inventor: Johann Philipp Dilo, Eberbach (DE)

(73) Assignee: Oskar Dilo Machinenfabrik KG, Eberbach (DE)

( * ) Notice: Subject to any disclaimer, the term of this patent is extended or adjusted under 35 U.S.C. 154(b) by 0 days.

(21) Appl. No.: 17/209,963

(22) Filed: Mar. 23, 2021

(65) Prior Publication Data

US 2021/0324558 A1 Oct. 21, 2021

(30) Foreign Application Priority Data

Apr. 17, 2020 (EP) ..... 20170250
Aug. 27, 2020 (EP) ..... 20193058

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 13/005; D04H 5/02; D04H 13/003; D04H 17/00; D04H 17/12
USPC ..... 28/107, 115
See application file for complete search history.

(56) References Cited

U.S. PATENT DOCUMENTS 2,974,393 A * 3/1961 Hollowell ..... D04H 18/02 28/107
3,538,564 A * 11/1970 Skoler ..... D04H 3/10 28/107
3,551,265 A * 12/1970 Cheves ..... D04H 18/04 28/100
3,621,540 A * 11/1971 Morrill ..... D04H 18/00 28/107
3,845,529 A * 11/1974 Van Deusen ..... D04H 18/02 28/109
5,819,383 A * 10/1998 Jourde ..... D04H 18/02 198/804

(Continued)

FOREIGN PATENT DOCUMENTS

DE 33 04 392 A1 8/1984
EP 3 165 660 A1 5/2017

OTHER PUBLICATIONS

EP 20 17 0250 Search Report dated Jul. 28, 2020.

*Primary Examiner* — Amy Vanatta
(74) *Attorney, Agent, or Firm* — Jansson Munger McKinley & Kirby Ltd.

(57) ABSTRACT

A needlepunching machine for needlepunching a flat textile material comprises a needle bar arranged in a needling zone, on which needle bar a needle board is arranged. A plurality of needles projects from the needle board. A drive device for the needle bar is configured to move the needle bar at least in an up-and-down stroking movement. Upper and lower support and guide for the flat textile material extend at least over the needling zone and guide the flat textile material between them. Both the upper and the lower support and guide are each formed by a plurality of parallel, tensioned wires, between which through-openings for the needles are arranged. The wires of the upper and lower support and guide are immovable in the conveying direction of the needlepunching machine.

15 Claims, 6 Drawing Sheets

(56) References Cited

U.S. PATENT DOCUMENTS

| | | | | |
|---|---|---|---|---|
| 6,161,269 | A | 12/2000 | Dilo et al. | |
| 6,374,469 | B1 * | 4/2002 | Baudry | D04H 18/02 28/107 |
| 6,385,825 | B1 * | 5/2002 | Wang | D04H 18/00 28/107 |
| 9,994,983 | B2 * | 6/2018 | Knopf | D04H 18/00 |
| 2004/0157036 | A1 * | 8/2004 | Provost | B32B 27/32 428/85 |
| 2006/0225258 | A1 * | 10/2006 | Barker | A61F 13/627 28/107 |
| 2015/0167216 | A1 * | 6/2015 | Dilo | D04H 18/02 28/114 |

* cited by examiner

NEEDLEPUNCHING MACHINE

FIELD OF THE INVENTION

The present invention pertains to a needlepunching machine for needlepunching a flat textile material such as nonwovens, woven fabric, or interlaid scrim.

BACKGROUND OF THE INVENTION

Needlepunching machines are well-known generally and are described in, for example, U.S. Pat. No. 6,161,269. When flat textile materials, especially nonwovens, are needlepunched, it is desirable to achieve the most uniform possible needling without causing any patterns to form in the flat textile material. It is an object of the present invention to provide a needlepunching machine by which a flat textile material can be needlepunched in an especially uniform manner.

SUMMARY OF THE INVENTION

According to an aspect of the invention, the needlepunching machine for needlepunching a flat textile material comprises at least one needle bar, on which at least one needle board is arranged, the needle bar being arranged in a needling zone, wherein a plurality of needles projects from the at least one needle board. The needlepunching machine also comprises at least one drive device for the at least one needle bar, which drive is configured to move the at least one needle bar at least in an up-and-down stroking motion. The needlepunching machine also comprises upper and lower support and a guide for the flat textile material, which upper and lower support and guide extend at least over the area of the needling zone, wherein an intermediate space for the passage of the flat textile material is formed between the upper support and guide and the lower support and guide. The upper support and guide are formed by a plurality of tensioned upper wires arranged in parallel, between which upper through-openings for the needles of the at least one needle board are arranged; and the lower support and guide are formed by a plurality of tensioned lower wires arranged in parallel, between which lower through-openings for the needles of the at least one needle board are arranged. The upper and lower wires of the upper and lower support and guide are supported in such a way that they are immovable in the conveying direction of the needlepunching machine.

A needlepunching machine of this type is especially appropriate for guaranteeing a high punching density of the needles in the flat textile material and for bringing about an especially uniform needlepunching of the flat textile material.

The upper and lower wires of the upper and lower support and guide are preferably fixed in position in the needlepunching machine. The wires do not move, and the flat textile material slides through the needling zone along the upper and lower support formed by the upper and lower wires.

The needlepunching machine is configured in such a way that it moves the flat textile material at least through the needling zone in the conveying direction. In other words, the conveying direction of the needlepunching machine corresponds to the conveying direction of the flat textile material at least in the needling zone.

In a preferred embodiment, the upper and lower wires of the upper and lower support and guide are stationary at least in the conveying direction. The upper and lower wires can be arranged so that they are completely stationary. It is also possible, however, for the upper and lower wires of the upper and lower support and guide to be movable relative to each other in a direction perpendicular to the conveying direction of the needlepunching machine, i.e., toward each other and away from each other. As a result, the intermediate space can be adapted to flat textile materials of different thicknesses.

To move the flat textile material through the needling zone in the conveying direction, the needlepunching machine, in each embodiment preferably comprises a conveying device for the flat textile material. The conveying device can comprise conveying apparatus which are arranged upstream, relative to the conveying direction, of the needling zone and which are set up to feed the flat textile material to the needling zone. These conveying apparatus arranged upstream of the needling zone comprise, for example, a conveyor belt and/or conveyor rolls. The conveying device, furthermore, can also, additionally or alternatively, comprise conveying apparatus which are arranged downstream from the needling zone and which are set up to pick up the flat textile material, i.e., a bonded flat textile material, downstream from the needling zone and to move it forward. These conveying apparatus arranged downstream from the needling zone comprise, for example, a conveyor belt and/or conveyor rolls.

If no conveying apparatus for the flat textile material are present in the needling zone itself, it is easier to obtain a needlepunching machine with a simple structure.

In a preferred embodiment, the number of adjacent wires of the upper and lower guide is at least 250 per meter of working width transverse to the conveying direction, preferably at least 400 per meter of working width, and even more preferably at least 500 per meter of working width; and the number of adjacent wires of the lower support and guide is at least 250 per meter of working width transverse to the conveying direction, preferably at least 400 per meter of working width, and even more preferably at least 500 per meter of working width. In this way, flat textile materials of conventional widths can be securely guided and supported in the needling zone.

The upper and lower wires of the upper support and guide and the wires of the lower support and guide are, in all embodiments, preferably of limited length, and each comprises a first free end and a second free end. The first free end of each wire is preferably fixed in position in the needlepunching machine upstream, relative to the conveying direction, of the needling zone, and the second free end is fixed in the needlepunching machine downstream, relative to the conveying direction, of the needling zone.

It is preferred that the wires of the upper support and guide and the wires of the lower support and guide be parallel to each other. This measure optimizes the guidance of the flat textile material in the needling zone.

Each wire preferably extends in the conveying direction F of the flat textile material. The longitudinal direction of each wire is then parallel to the conveying direction of the flat textile material. The wires are therefore supported in the needlepunching machine so that they are immobile in the conveying direction and in their longitudinal direction.

The wires can also extend at a slant to the conveying direction of the flat textile material. A longitudinal direction of each wire is than at an angle to the conveying direction of the flat textile material. The longitudinal direction of each wire will thus have a component parallel to the conveying direction and a component perpendicular to the conveying direction. The wires are, in this case as well, supported in the needlepunching machine in such a way that they are immovable in the conveying direction and preferably also in the direction perpendicular to the conveying direction.

In a preferred embodiment, the wires of the upper support and guide and the wires of the lower support and guide are aligned with each other in the vertical direction. This guarantees that, during the punching process, none of the needles can collide with the wires of the upper support and guide or with the wires of the lower support and guide.

In all of the embodiments, the needlepunching machine preferably comprises at least one hold-down plate and at least one punching plate, both plates being arranged in the needling zone. The hold-down plate and the punching plate then constitute the upper support and guide and the lower support and guide. For example, the upper support and guide form, with respect to the needle bar, a hold-down plate for holding down the flat textile material when the needles of the needle bar are pulled out of the flat textile material, and the lower support and guide form, with respect to the needle bar, a punching plate for supporting and holding up the flat textile material when the needles of the needle bar penetrate into the flat textile material and pass through it. It is obvious that, in cases where the needle bar is arranged underneath the flat textile material, the upper support and guide can also form a punching plate, and the lower support and guide can also form a hold-down plate. It is also possible that, in the case of a double needlepunching machine with an upper needle board and a lower needle board, both the upper support and guide and the lower support and guide can form both a hold-down plate for the needles of one of the needle boards and also a punching plate for the needles of the other needle board.

To obtain a needlepunching machine with the simplest possible structure, all of the punching and hold-down plates of the needlepunching machine, in all embodiments, are preferably formed exclusively by the wires of the upper and lower support and guide. No additional punching or hold-down plates are provided.

It is preferred that the upper through-openings between the wires of the upper support and guide have a width of between 0.5 mm and 10 mm, preferably of between 0.7 mm and 8 mm, and even more preferably of between 0.8 mm and 5 mm.

Alternatively or in combination with this, it is preferred that the lower through-openings between the wires of the lower support and guide have a width of between 0.5 mm and 10 mm, preferably of between 0.7 mm and 8 mm, and even more preferably of between 0.8 mm and 5 mm.

In a preferred embodiment, the wires of the upper support and guide have a diameter of between 0.4 mm and 2 mm, preferably of between 0.5 mm and 1.5 mm, and even more preferably of between 0.6 mm and 1.2 mm.

Alternatively or in combination with this, it is preferred that the wires of the lower support and guide have a diameter of between 0.4 mm and 2 mm, preferably of between 0.5 mm and 1.5 mm, and even more preferably of between 0.6 mm and 1.2 mm.

The small diameters of the wires promote an especially dense punching pattern and an especially uniformly bonded end product.

In a preferred embodiment, the needles are arranged in rows, which are parallel to the direction in which the wires of the upper support and guide extend, and which are arranged with a spacing from each other which corresponds to the distance between the wires of the upper support and guide. In this way, it is ensured that, in each case, exactly one row of needles can be accommodated in one through-opening, as a result of which the support and stripping function of the upper support and guide is guaranteed in an especially reliable manner. In particular, this measure effectively prevents fibers from being carried along when the needles are pulled out of the flat textile material.

In a preferred embodiment, the needlepunching machine also comprises a cleaning device for each wire. This is useful in particular as a way of removing fibers from the wire, i.e., the fibers which are pulled from the flat textile material during the punching process, and thus to ensure the smooth operation of the punching process.

In a preferred embodiment, the cleaning device comprises a projection, which extends at a slant toward the associated wire and contacts it on one side of the wire in question, namely, on the side facing away from the intermediate space formed between the upper and lower support and guide. Thus fibers on the wire, which are being carried along in the conveying direction by the conveying movement of the flat textile material, are lifted from the wire in question, as a result of which the intermediate space between the upper and lower support and guide is thus prevented from becoming clogged.

In a preferred embodiment, the needlepunching machine also comprises a tensioning device for each wire. The first and/or the second end of each wire is preferably fastened to a tensioning element. The tensioning element, e.g., a bolt or pin, can be supported rotatably, and the first or second end of the wire is wound around the tensioning element, so that the wire can be tensioned by turning the tensioning element. Thus the tension of the wire can be readjusted in the manner of a string of a piano, and the wires can also be easily replaced.

In a preferred embodiment, a deflecting device for each wire is also arranged between the tensioning device and the needling zone; through the deflecting device, each wire can be deflected by an angle of between 60° and 120°, preferably between 70° and 110°, and even more preferably by an angle of between 80° and 100°, relative to its arrangement in the needling zone. As a result, the wires can be bent upward or downward in an area outside the needling zone and thus present no obstacle to the flat textile material.

In a preferred embodiment, the needles in each needle board are arranged in a density of at least 500 needles/dm$^2$, preferably at least 1,000 needles dm$^2$, more preferably at least 1,500 needles/dm$^2$. Such high needle densities lead to an especially uniform punching pattern in the bonded end product.

In a preferred embodiment, the needles are arranged in needle modules, wherein each needle module comprises a plurality of needles, and wherein the needle modules are mounted in recesses or carriers of the at least one needle board and are fastened there. The arrangement of the needles in needle modules offers several advantages. One of these is that individual needle modules can be replaced if defective needles are present, there being no need to remove the entire needle board to install new needles. The needle modules can also be arranged so that they can be shifted in the needle board, and thus the punching pattern and the way in which the needle board is equipped can be made variable. In addition, the needle modules can be arranged so closely together that there is no intermediate space between the individual modules.

In all of the embodiments, the wires are preferably configured as metal wires, especially steel wires, which are preferably nonrusting.

The needling zone in all of the embodiments extends preferably over a range of 20 cm to 200 cm, more preferably of 25 cm to 80 cm, in the conveying direction F.

The needling zone in all of the embodiments extends preferably over a range of 200 cm to 500 cm, more preferably of 250 cm to 400 cm, transversely to the conveying direction F.

Each needle module can comprise a single longitudinal row of needles or several longitudinal rows of needles.

DETAILED DESCRIPTION OF SPECIFIC EMBODIMENTS

Figure 1:
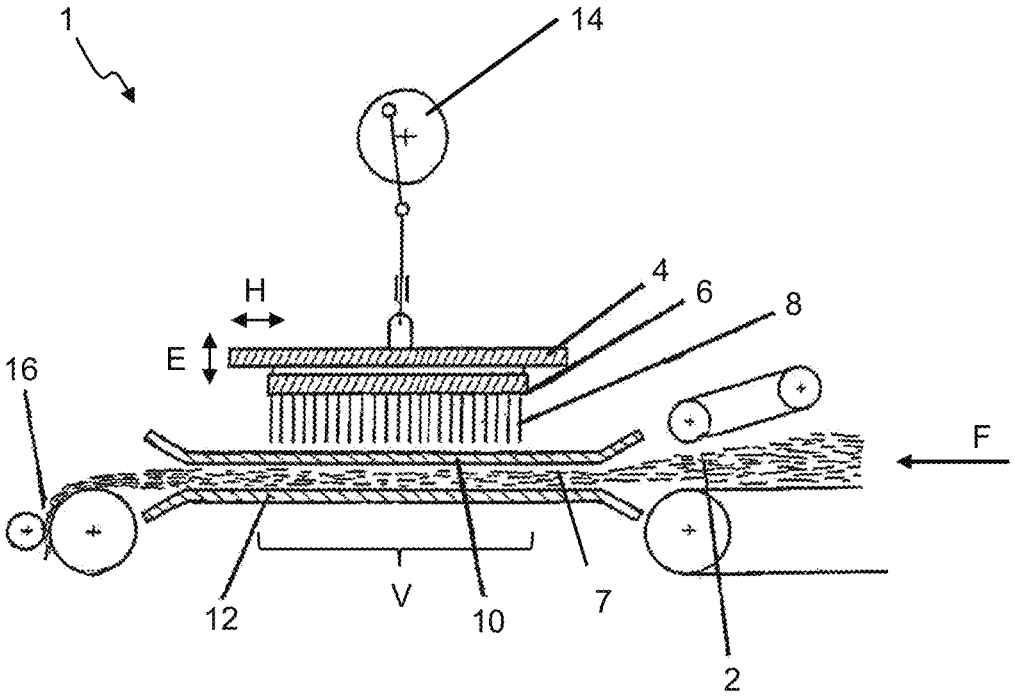
FIG. 1 shows a schematic side view of the essential components of a needlepunching machine.

FIG. 1 shows a schematic side view of the structure of a needlepunching machine 1. A flat textile material 2, such as a nonwoven web, is fed to an inlet of the needlepunching machine 1 and conveyed to a needling zone V. A needle bar 4, to which a needle board 6 is attached, is arranged in the area of the needling zone V. The needle board is equipped with needles 8 for bonding flat textile material 2. In this area, flat textile material 2 to be needlepunched is guided through an intermediate space 7 between upper support and guide 10 for holding down flat textile material 2 and lower support and guide 12 for supporting flat textile material 2 in the needling zone V. Needles 8 bond flat textile material 2, in that they are punched at high frequency into flat textile material 2 and pulled back out again. As this is happening, needles 8 pass through upper and lower through-openings 30, 32 in the upper support and guide 10 and in lower support and guide 12 (see FIG. 6*a*). Whereas upper and lower support and guide 10, 12 are sketched only schematically in FIG. 1, the actual configuration of the upper and lower support and guide 10, 12 according to the present invention is shown in greater detail in the following figures.

As can be seen in FIG. 1, a drive device 14, which is configured, for example, as a conrod drive, is preferably provided to raise and lower needles 8 in a punching direction E.

To prevent distortions from occurring in flat material 2 while needles 8 are located in flat material 2 and the flat material is being moved further onward in the conveying direction F, needle board 6 with the needles can, in a preferred embodiment of a needlepunching machine 1, execute a horizontal stroke H parallel to the conveying direction F. Needle board 6 with needles 8 can be moved together with flat textile material 2 in the conveying direction F. Especially while needles 8 are still in the flat textile material after they have been pushed through it, needles 8 are moved along concomitantly with flat material 2 to minimize any relative movement between needles 8 and flat material 2. To bring about the horizontal stroke H, it is possible to provide a secondary drive acting on needle board 6; or drive device 14 can be configured or coupled appropriately with needle bar 4 in a certain way as will be familiar to the skilled person.

The resulting product is a bonded flat textile material 16 such as a nonwoven.

The skilled person is familiar with a wide variety of needlepunching machines 1, including double needlepunching machines, in which punching is carried out from above and from below by two needle bars 4; needlepunching machines with one or more needle boards 6 per needle bar; and needlepunching machines with a horizontal stroke and machines without a horizontal stroke. It is obvious that the present invention can be applied to various forms of needlepunching machines and is not limited to the embodiment of a needlepunching machine 1 described herein.

Figure 2:
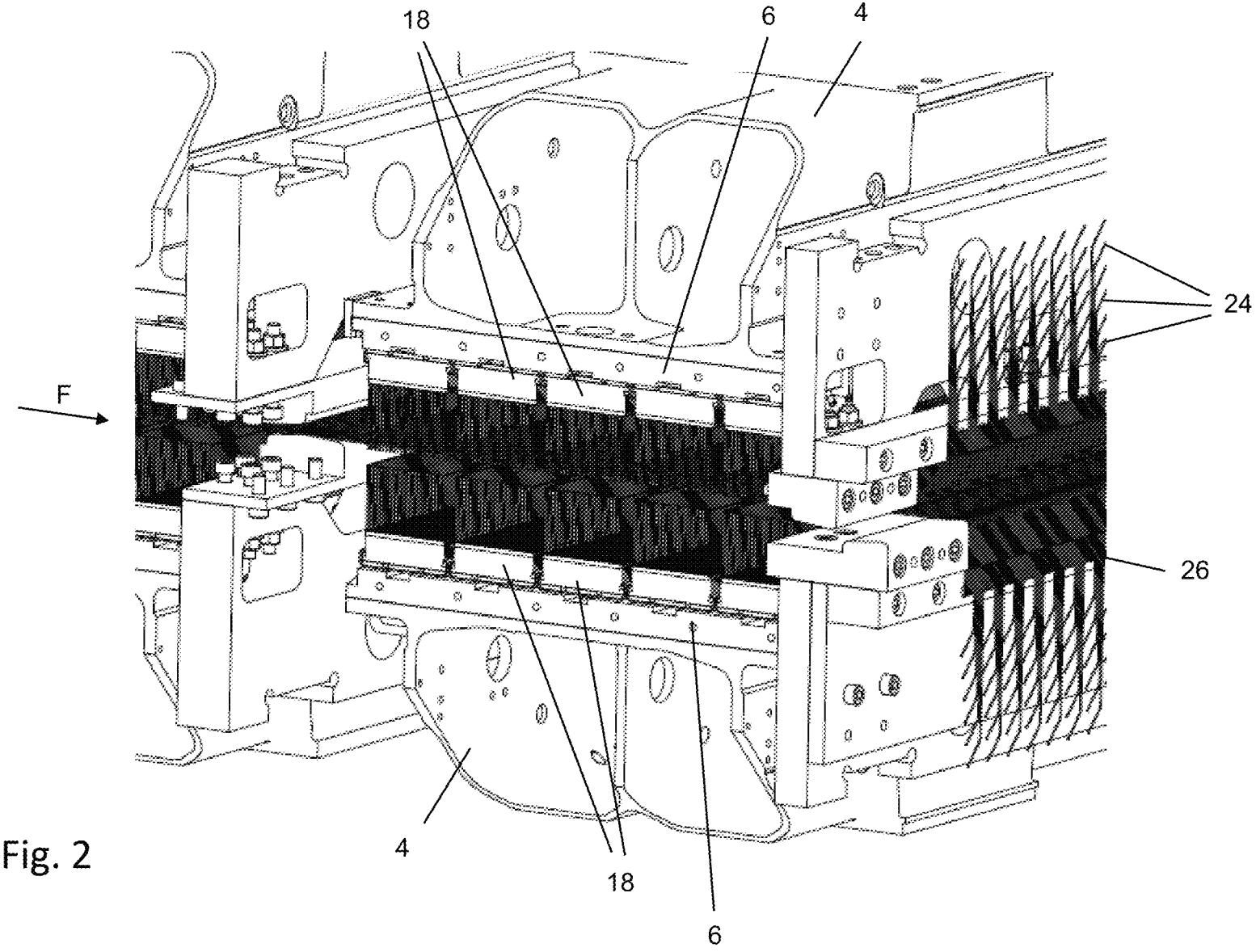
FIG. 2 shows a perspective view of part of the needling zone of a needlepunching machine according to the invention.
Figure 3:
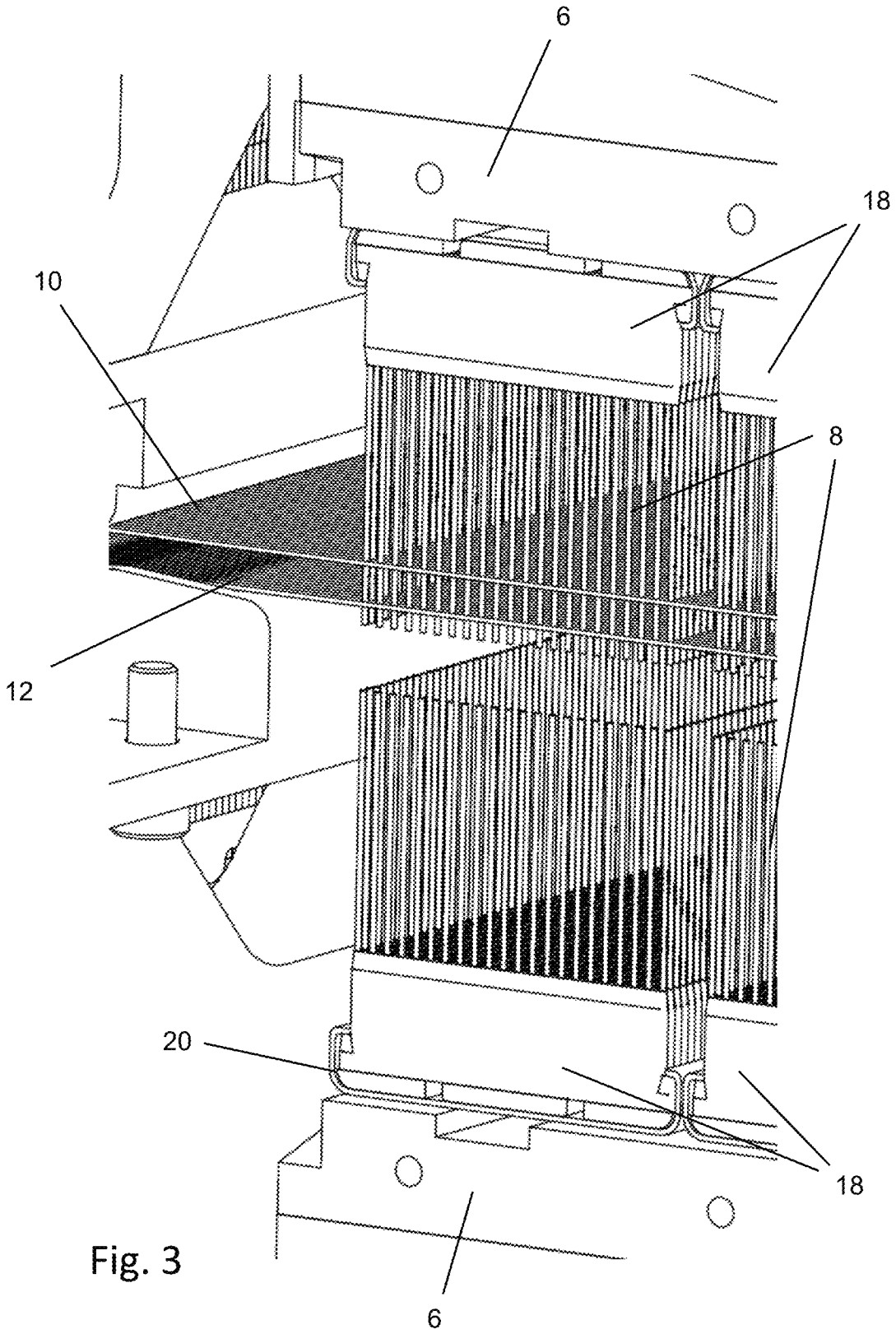
FIG. 3 shows a perspective view of an enlarged part of the needlepunching machine according to FIG. 2.
Figure 4:
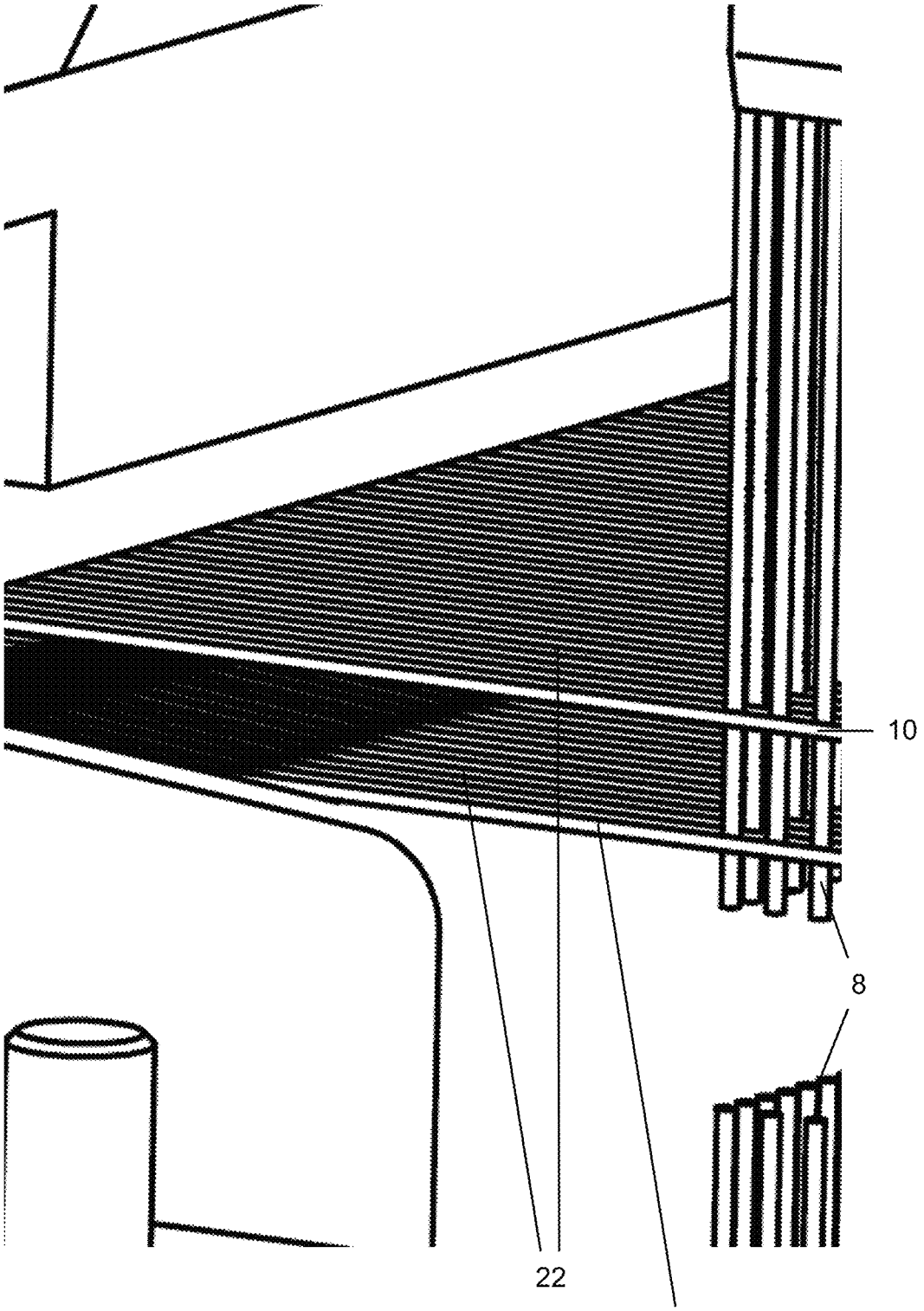
FIG. 4 shows a perspective view of an enlarged part of the needlepunching machine of FIG. 3.

FIGS. 2-4 show by way of example an embodiment of the needlepunching machine according to the invention in greater detail. The needlepunching machine illustrated here is a double needlepunching machine with an upper needle board 6 and a lower needle board 6. Here the lower support and guide 12 simultaneously have a hold-down function for needles 8 of needle board 6 arranged underneath flat material 2. In a configuration such as this, needles 8 of the two needle boards 6 are punched alternately into flat textile material 2 and, because the punching movements are offset from each other in time, they cannot interfere with each other. In a case like this, needles 8 on two needle boards 6 are arranged with mirror symmetry to the longitudinal center plate between needle boards 6, but they could also be arranged with an offset from each other.

FIGS. 2-4 show needles 8 of the upper needle board 6*a* in their punching position; in this position, these needles 8 extend through through-openings 30, 32 in the upper support and guide 10 and in the lower support and guide 12. When needles 8 of lower needle board 6 are in their punching position, lower needles 8 would extend through through-openings 30, 32 in corresponding fashion. Needles 8 in FIGS. 2-4 are illustrated with blunt tips to simplify the illustration. In reality, the tips of needles 8 are sharply pointed.

As can be seen most clearly in FIG. 3, needles 8 are mounted in needle modules 18, which are mounted in turn in receptacles or carriers 20 of needle board 6. In the example shown here, C-shaped carriers 20 are provided to hold a thicker section of needle module 18. On its open side, carrier 20 comprises two shoulders, which extend inward toward each other. Thus, after needle module 18 has been pushed into C-shaped carrier 20, a positive connection is established, which prevents needle module 18 from moving in the punching direction E relative to carrier 20.

Needle modules 18 can be arranged in rows and columns in needle board 6, as can be seen in FIG. 2. The arrangement of needle modules 18 can be selected in almost any way desired, as long as needles 8 in question always pass through the through-openings 30, 32 of the support and guide during the punching movement. It thus possible in this way to configure rows of needles with several dozen or several hundred needles 8 in the conveying direction F of flat textile material 2.

It is also conceivable, however, that conventional needle boards 6 could be used, in which the needles are introduced directly into needle board 6, which indicates that no needle modules 18 are present.

Each needle bar 4 can comprise exactly one needle board 6 or comprise two or more needle boards 6. Several needlepunching machines can also be arranged one after the other in the conveying direction F.

Figure 6A:
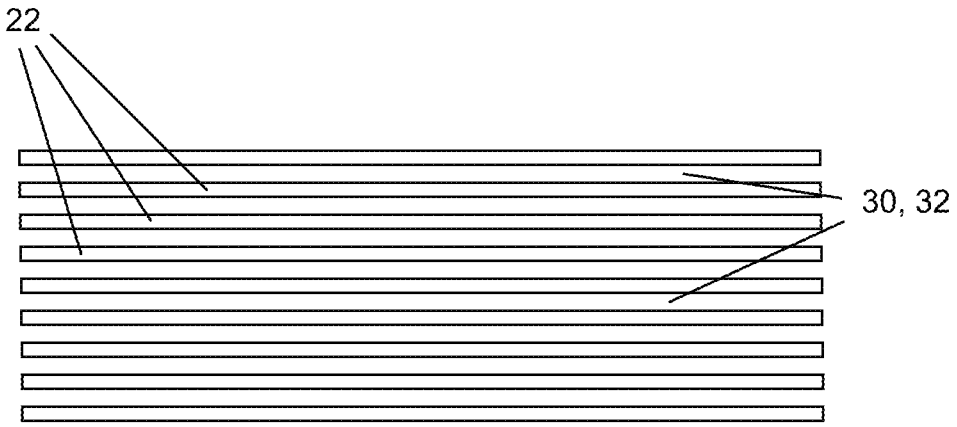
FIG. 6*a* shows an enlarged top view of wires arranged in parallel in the needling zone.
Figure 6B:
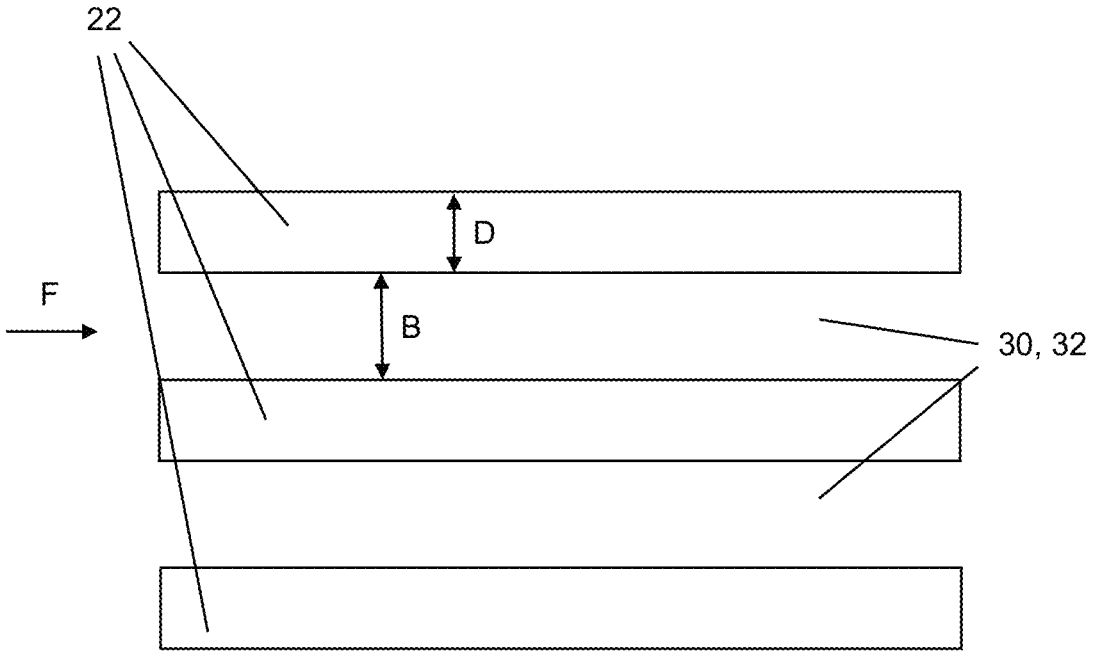
FIG. 6*b* shows an even more enlarged top view of wires of FIG. 6*a.*

As can be seen most clearly in FIGS. 4 and 6*a*, the upper support and guide 10 and the lower support and guide 12 are, according to the invention, each formed by parallel, tensioned upper or lower wires 22. Wires 22 preferably extend in the conveying direction F of flat textile material 2. The arrangement of wires 22 in the upper support and guide 10 and the arrangement in the lower support and guide 12 preferably correspond to each other, so that through-openings 30, with respect to their arrangement, will also correspond to through-openings 32. As can be seen from the enlarged top views in FIGS. 6*a* and 6*b*, through-openings 30, 32 between upper and lower wires 22 of the upper and lower support and guide 10, 12 have a width B of between 0.5 mm and 10 mm. Wires 22 of the upper and lower support and guide 10, 12 have a diameter D of between 0.4 mm and 2 mm.

In the present embodiment, each needle 8 is arranged in such a way transversely to the conveying direction F that it corresponds to a through-opening 30, 32. It is also possible, however, that two or more needles 8 adjacent to each other transversely to the conveying direction F could pass through one of the through-openings 30, 32 during the punching movement of the needles 8.

As indicated schematically in FIG. 2, upper wires 22 of the upper support and guide 10 are bent up at the front and rear ends of the needle board 4, and lower wires 22 of lower support and guide 12 are bent down at the front and rear ends of needle board 4. They are brought to the desired tension through the use of appropriate tensioning devices 24 (here indicated only schematically) for each wire 22. In FIG. 2, only the course of wires 22 at the rear end of needle bar 4 can be seen. At the front end, the course of wires 22 is symmetric to that. As can also be seen in FIG. 2, a deflecting device 26 is provided between tensioning device 24 and the needling zone V. By deflecting device 26, wire 22 in question can be deflected around an angle of between 60° and 120° relative to its arrangement in the needling zone V. Preferably the angle is 90°. Thus the path along which wires 22 proceed acquires the shape of a "U".

Figure 5A:
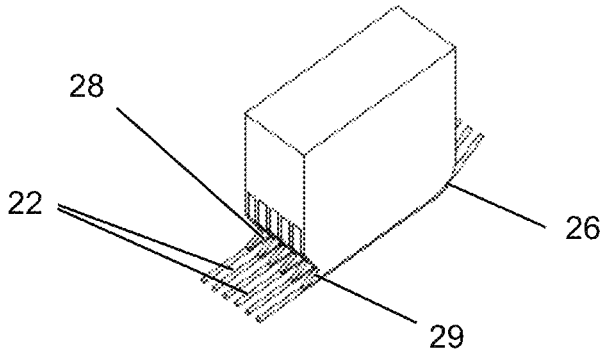
FIG. 5*a* shows a perspective view of a possible embodiment of a cleaning device for the wires.
Figure 5B:
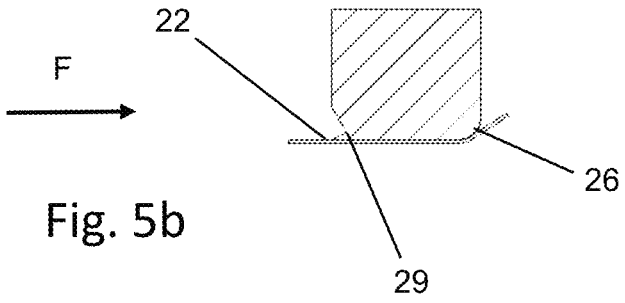
FIG. 5*b* shows a cross-sectional view of the cleaning device of FIG. 5*a;*

Finally, the needlepunching machine also comprises a cleaning device 28, preferably arranged downstream from the needling zone V, for each wire 22. A possible embodiment of this cleaning device 28 is shown in FIGS. 5*a* and 5*b*. In the embodiment shown here, cleaning device 28 is formed by a projection 29, which extends from above or from below at a slant toward the associated wire 22, and also at a slant pointing away from the conveying direction F, and contacts wire 22. It is preferred that each projection 29 have a groove at its tip, which wire 22 at least partially accommodates. This also guarantees effective guidance for wires 22. With an arrangement like this, fibers being carried along wire 22 can be conducted by the projection in an upward direction into a recess, as a result of which a clogging in the outlet area of the support and guide 10, 12 is prevented.

It can be necessary for cleaning device 28 to comprise additional components, which have the job of permanently removing the fibers conducted into the recesses from the recesses. For this purpose, it is possible to use, for example, brushes or blowing devices.

As shown in FIGS. 5*a* and 5*b*, the cleaning device 28 can also form an integral part of the deflecting device 26 or of a section of deflecting device 26.

When, within the scope of the invention, several needle boards 6 are arranged one behind the other or when several needlepunching machines 2 are arranged one behind the other, it is advantageous for the rows of needles of the trailing needle board 6 to be arranged with an offset transversely to the conveying direction F from the rows of needles of the leading needle board 6. An especially uniform punching pattern is thus obtained.

The invention claimed is:

1. A needlepunching machine for needlepunching a flat textile material, comprising:

at least one needle bar arranged in a needling zone, wherein at least one needle board is arranged on the at least one needle bar, wherein a plurality of needles projects from the at least one needle board;

at least one drive device for the at least one needle bar, wherein the at least one drive device is configured to move the at least one needle bar at least in an up-and-down stroking movement; and upper and lower support and guide for the flat textile material, wherein the upper and lower support and guide extend at least over the needling zone, wherein an intermediate space is formed between the upper support and guide and the lower support and guide for the passage of the flat textile material in a conveying direction of the needlepunching machine;

wherein the upper support and guide is formed by a plurality of parallel, tensioned upper wires, wherein upper through-openings for the needles of the at least one needle board are arranged between the upper wires;

wherein the lower support and guide is formed by a plurality of parallel, tensioned lower wires, wherein lower through-openings for the needles of the at least one needle board are arranged between the lower wires; and wherein the upper and lower wires of the upper and lower support and guide are supported in such a way that the upper and lower wires of the upper and lower support and guide are immovable in the conveying direction of the needlepunching machine.

2. The needlepunching machine according to claim 1 wherein the number of adjacent upper wires of the upper support and guide is at least 250 per meter of working width transverse to the conveying direction, and wherein the number of adjacent lower wires of the lower support and guide is at least 250 per meter of working width transverse to the conveying direction of the needlepunching machine.

3. The needlepunching machine according to claim 1 wherein the upper wires of the upper support and guide and the lower wires of the lower support and guide are arranged parallel to each other and, at least in the needling zone, extend in the conveying direction of the needlepunching machine.

4. The needlepunching machine according to claim 1 wherein, in the needling zone, the upper wires of the upper support and guide and the lower wires of the lower support and guide in and of themselves form a hold-down plate and a punching plate of the needlepunching machine without any additional structural elements.

5. The needlepunching machine according to claim 1 wherein the upper wires of the upper support and guide and the lower wires of the lower support and guide are aligned with each other in the vertical direction.

6. The needlepunching machine according to claim 1 wherein the upper through-openings between the upper wires of the upper support and guide have a width of between 0.5 mm and 10 mm, and wherein the lower through-openings between the lower wires of the lower support and guide have a width of between 0.5 mm and 10 mm.

7. The needlepunching machine according to claim 1 wherein the upper wires of the upper support and guide have a diameter of between 0.4 mm and 2 mm, and the lower wires of the lower support and guide have a diameter of between 0.4 mm and 2 mm.

8. The needlepunching machine according to claim 1 wherein the needles are arranged in rows, wherein the rows are parallel to a direction in which the upper wires of the upper support and guide extend, and wherein the rows are arranged a certain distance apart, wherein the distance corresponds to a spacing of the upper wires of the upper support and guide.

9. The needlepunching machine according to claim 1 further comprising a cleaning device for each wire.

10. The needlepunching machine according to claim 9 wherein the cleaning device is arranged downstream from the needling zone.

11. The needlepunching machine according to claim 10 wherein the cleaning device of each wire comprises a projection, wherein the projection extends at a slant toward the associated wire and contacts it on a side of the associated wire facing away from the intermediate space formed between the upper and lower support and guide.

12. The needlepunching machine according to claim 1 further comprising a tensioning device for each wire.

13. The needlepunching machine according to claim 12 wherein, between the tensioning device and the needling zone, a deflecting device for each wire is provided, through which the deflecting device the associated wire is deflected around an angle of between 60° and 120° relative to its arrangement in the needling zone.

14. The needlepunching machine according to claim 1 wherein the needles in each needle board are arranged in a density of at least 500 needles/$dm^2$.

15. The needlepunching machine according to claim 1 wherein the needles are arranged in needle modules, wherein each needle module comprises a plurality of needles, and wherein the needle modules are mounted in recesses or carriers of the at least one needle board.

* * * * *